US010411393B2

(12) United States Patent
Rodrigues et al.

(10) Patent No.: US 10,411,393 B2
(45) **Date of Patent: *Sep. 10, 2019**

(54) COAXIAL CONNECTOR HAVING DETACHABLE LOCKING SLEEVE

(71) Applicant: PPC Broadband, Inc., East Syracuse, NY (US)

(72) Inventors: Julio F. Rodrigues, Collierville, TN (US); Salvatore J. Abbruzzese, Piscataway, NJ (US); Brian S. Welborn, The Woodlands, TX (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/830,438

(22) Filed: Dec. 4, 2017

(65) Prior Publication Data

US 2018/0090871 A1 Mar. 29, 2018

Related U.S. Application Data

(63) Continuation of application No. 15/200,916, filed on Jul. 1, 2016, now Pat. No. 9,837,752, which is a (Continued)

(51) Int. Cl.
*H01R 9/05* (2006.01)
*H01R 13/506* (2006.01)
(Continued)

(52) U.S. Cl.
CPC ..... *H01R 13/506* (2013.01); *H01R 9/0521* (2013.01); *H01R 9/0524* (2013.01);
(Continued)

(58) Field of Classification Search
None
See application file for complete search history.

(56) References Cited

U.S. PATENT DOCUMENTS 1,667,485 A 4/1928 Macdonald
2,258,737 A 10/1941 Browne
(Continued)

FOREIGN PATENT DOCUMENTS

DE 1022289 B 1/1958
DE 1117687 B 11/1961
(Continued)

OTHER PUBLICATIONS

Third Party Requestor's Comments After Office Action in Reexamination and Patent Owner Response filed with the U.S. Patent and Trademark Office dated Dec. 28, 2007 for U.S. Appl. No. 95/000,112, 29 pages.

(Continued)

*Primary Examiner* — Tho D Ta
(74) *Attorney, Agent, or Firm* — Oliff PLC

(57) ABSTRACT

A connector is provided for attachment to a coaxial cable. The connector includes, in one embodiment, a connector body and a locking sleeve. The locking sleeve is configured to be moved between an attached and a detached state. In each such state, the locking sleeve is configured to receive the end of the cable. In one position, the locking sleeve is configured to lock the end of the cable to the connector body.

24 Claims, 2 Drawing Sheets

Related U.S. Application Data continuation of application No. 14/550,021, filed on Nov. 21, 2014, now Pat. No. 9,385,467, which is a continuation of application No. 13/903,348, filed on May 28, 2013, now Pat. No. 8,894,440, which is a continuation of application No. 12/254,238, filed on Oct. 20, 2008, now Pat. No. 8,449,324, which is a continuation of application No. 11/657,868, filed on Jan. 25, 2007, now Pat. No. 7,458,849, which is a continuation of application No. 10/848,497, filed on May 18, 2004, now Pat. No. 7,192,308, which is a continuation of application No. 10/359,498, filed on Feb. 6, 2003, now Pat. No. 6,767,247, which is a continuation of application No. 09/852,343, filed on May 9, 2001, now Pat. No. 6,530,807.

(60) Provisional application No. 60/215,299, filed on Jun. 30, 2000, provisional application No. 60/202,972, filed on May 10, 2000.

(51) Int. Cl.
*H01R 13/52* (2006.01)
*H01R 24/38* (2011.01)
*H01R 103/00* (2006.01)

(52) U.S. Cl.
CPC ..... *H01R 13/5202* (2013.01); *H01R 24/38* (2013.01); *H01R 2103/00* (2013.01); *Y10T 29/49169* (2015.01)

(56) References Cited

U.S. PATENT DOCUMENTS

| | | | |
|---|---|---|---|
| 2,549,647 | A | 4/1951 | Turene |
| 3,076,168 | A | 1/1963 | Keen |
| 3,097,399 | A | 7/1963 | Alston |
| 3,184,706 | A | 5/1965 | Atkins |
| 3,275,913 | A | 9/1966 | Blanchard |
| 3,292,136 | A | 12/1966 | Somerset |
| 3,350,677 | A | 10/1967 | Daum |
| 3,355,696 | A | 11/1967 | Keller |
| 3,355,698 | A | 11/1967 | Keller |
| 3,373,243 | A | 3/1968 | Janowiak |
| 3,406,373 | A | 10/1968 | Forney, Jr. |
| 3,448,430 | A | 6/1969 | Kelly |
| 3,449,430 | A | 6/1969 | Kelly |
| 3,475,545 | A | 10/1969 | Stark |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,564,487 | A | 2/1971 | Upstone |
| 3,629,792 | A | 12/1971 | Dorrell |
| 3,633,150 | A | 1/1972 | Swartz |
| 3,668,612 | A | 6/1972 | Nepovim |
| 3,671,922 | A | 6/1972 | Zerlin et al. |
| 3,694,792 | A | 9/1972 | Wallo |
| 3,694,793 | A | 9/1972 | Concelman |
| 3,710,005 | A | 1/1973 | French |
| 3,778,535 | A | 12/1973 | Forney, Jr. |
| 3,781,762 | A | 12/1973 | Quackenbush |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,098 | A | 4/1976 | Avery et al. |
| 3,963,320 | A | 6/1976 | Spinner |
| 3,976,352 | A | 8/1976 | Spinner |
| 3,980,805 | A | 9/1976 | Lipari |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,554 | A | 8/1979 | Faget |
| 4,168,921 | A | 9/1979 | Blanchard |
| 4,225,162 | A | 9/1980 | Dola |
| 4,227,765 | A | 10/1980 | Neumann et al. |
| 4,250,348 | A | 2/1981 | Kitagawa |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward |
| 4,408,821 | A | 10/1983 | Forney, Jr. |
| 4,408,822 | A | 10/1983 | Nikitas |
| 4,421,376 | A | 12/1983 | Cosmos et al. |
| 4,421,377 | A | 12/1983 | Spinner |
| 4,444,453 | A | 4/1984 | Kirby et al. |
| 4,456,323 | A | 6/1984 | Pitcher |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,637 | A | 10/1985 | Bosshard et al. |
| 4,575,274 | A | 3/1986 | Hayward |
| 4,583,811 | A | 4/1986 | McMills |
| 4,589,961 | A | 5/1986 | Gershenson |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,666,229 | A | 5/1987 | Grand |
| 4,668,043 | A | 5/1987 | Saba et al. |
| 4,674,818 | A | 6/1987 | McMills et al. |
| 4,676,577 | A | 6/1987 | Szegda |
| 4,676,588 | A | 6/1987 | Bowen et al. |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,710,005 | A | 12/1987 | Bennett |
| 4,717,355 | A | 1/1988 | Mattis |
| 4,738,008 | A | 4/1988 | Proctor |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,761,146 | A | 8/1988 | Sohoel |
| 4,772,222 | A | 9/1988 | Laudig et al. |
| 4,789,355 | A | 12/1988 | Lee |
| 4,806,116 | A | 2/1989 | Ackerman |
| 4,813,886 | A | 3/1989 | Roos et al. |
| 4,834,675 | A | 5/1989 | Samchisen |
| 4,834,676 | A | 5/1989 | Tackett |
| 4,854,893 | A | 8/1989 | Morris |
| 4,857,014 | A | 8/1989 | Alf et al. |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,923,412 | A | 5/1990 | Morris |

(56) References Cited

U.S. PATENT DOCUMENTS 4,925,403 A 5/1990 Zorzy
4,927,385 A 5/1990 Cheng
4,929,188 A 5/1990 Lionetto et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
5,002,503 A 3/1991 Campbell et al.
5,007,861 A 4/1991 Stirling
5,021,010 A 6/1991 Wright
5,024,606 A 6/1991 Ming-Hwa
5,037,328 A 8/1991 Karlovich
5,062,804 A 11/1991 Jamet et al.
5,066,248 A 11/1991 Gaver, Jr. et al.
5,073,129 A 12/1991 Szegda
5,083,943 A 1/1992 Tarrant
5,120,260 A 6/1992 Jackson
5,127,853 A 7/1992 McMills et al.
5,131,862 A 7/1992 Gershfeld
5,141,451 A 8/1992 Down
5,161,993 A 11/1992 Leibfried, Jr.
5,181,161 A 1/1993 Hirose et al.
5,195,906 A 3/1993 Szegda
5,205,761 A 4/1993 Nilsson
5,207,602 A 5/1993 McMills et al.
5,217,391 A 6/1993 Fisher, Jr.
5,217,393 A 6/1993 Del Negro et al.
5,269,701 A 12/1993 Leibfried, Jr.
5,283,853 A 2/1994 Szegda
5,284,449 A 2/1994 Vaccaro
5,295,864 A 3/1994 Birch et al.
5,316,494 A 5/1994 Flanagan et al.
5,338,225 A 8/1994 Jacobsen et al.
5,342,218 A 8/1994 McMills et al.
5,354,217 A 10/1994 Gabel et al.
5,371,819 A 12/1994 Szegda
5,371,821 A 12/1994 Szegda
5,371,827 A 12/1994 Szegda
5,393,244 A 2/1995 Szegda
5,431,583 A 7/1995 Szegda
5,435,745 A 7/1995 Booth
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,251 A 11/1995 Sano
5,470,257 A * 11/1995 Szegda ..... H01R 9/05 439/389
5,494,454 A 2/1996 Johnsen
5,501,616 A 3/1996 Holliday
5,525,076 A 6/1996 Down
5,542,861 A 8/1996 Anhalt et al.
5,548,088 A 8/1996 Gray et al.
5,571,028 A 11/1996 Szegda
5,586,910 A 12/1996 Del Negro et al.
5,598,132 A 1/1997 Stabile
5,607,325 A 3/1997 Toma
5,620,339 A 4/1997 Gray et al.
5,632,651 A 5/1997 Szegda
5,651,699 A 7/1997 Holliday
5,667,405 A 9/1997 Holliday
5,690,510 A 11/1997 Chishima
5,769,662 A 6/1998 Stabile et al.
5,800,211 A 9/1998 Stabile et al.
5,863,220 A 1/1999 Holliday
5,879,191 A 3/1999 Burris
5,967,852 A 10/1999 Follingstad et al.
5,975,951 A 11/1999 Burris et al.
5,997,350 A 12/1999 Burris et al.
6,032,358 A 3/2000 Wild
6,089,813 A 7/2000 McNeilus et al.
6,089,912 A 7/2000 Tallis et al.
6,089,913 A 7/2000 Holliday
6,146,197 A 11/2000 Holliday et al.
6,159,046 A 12/2000 Wong
D436,076 S 1/2001 Montena
6,179,656 B1 1/2001 Wong
D437,826 S 2/2001 Montena
D437,828 S 2/2001 Corona
D440,539 S 4/2001 Montena
D440,939 S 4/2001 Montena
6,210,222 B1 4/2001 Langham et al.
6,241,553 B1 6/2001 Hsia
6,267,621 B1 7/2001 Pitschi et al.
6,332,808 B1 12/2001 Kanda et al.
6,352,448 B1 3/2002 Holliday et al.
6,383,019 B1 5/2002 Wild
D458,904 S 6/2002 Montena
D460,739 S 7/2002 Fox
D460,740 S 7/2002 Montena
D460,946 S 7/2002 Montena
D460,947 S 7/2002 Montena
D460,948 S 7/2002 Montena
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
D468,696 S 1/2003 Montena
6,530,807 B2 3/2003 Rodrigues et al.
6,558,194 B2 5/2003 Montena
6,719,222 B2 4/2004 Mebberson
6,767,247 B2 7/2004 Rodrigues et al.
6,817,896 B2 11/2004 Derenthal
6,848,940 B2 2/2005 Montena
7,192,308 B2 3/2007 Rodrigues et al.
7,458,849 B2 12/2008 Rodrigues et al.
8,449,324 B2 * 5/2013 Rodrigues ..... H01R 9/0521 439/578
8,894,440 B2 * 11/2014 Rodrigues ..... H01R 9/0521 439/578
2003/0003705 A1 1/2003 Chung et al.
2003/0162439 A1 8/2003 Rodrigues et al.

FOREIGN PATENT DOCUMENTS

DE 1191880 B 4/1965
DE 047931 C 5/1966
DE 1515398 BI 4/1970
DE 2225764 A1 12/1972
DE 2221936 A1 11/1973
DE 2261973 A1 6/1974
DE 3211008 A1 10/1983
EP 0072104 A1 2/1983
EP 0116157 A1 8/1984
EP 0167738 A2 1/1986
EP 0265276 A2 4/1988
FR 2232846 A1 1/1975
FR 2234680 A2 1/1975
FR 2462798 A1 2/1981
GB 0589697 A 6/1947
GB 1087228 A 10/1967
GB 1270846 A 4/1972
GB 2019665 A 10/1979
GB 2079549 A 1/1982
JP 3069068 B2 5/2000
JP 3075662 B2 12/2000
WO 9324973 A1 12/1993
WO 9608854 A1 3/1996
WO 9818179 A1 4/1998
WO 9907035 A2 2/1999

OTHER PUBLICATIONS

Non-final Office Action filed by the U.S. Patent and Trademark Office dated Feb. 29, 2008 for U.S. Appl. No. 95/000,112, 12 pages.

(56) References Cited

OTHER PUBLICATIONS

Amendment and Response by Patent Owner to a Non-Final Office Action filed with the U.S. Patent and Trademark Office dated Mar. 31, 2008 for U.S. Appl. No. 95/000,112, 20 pages.
Third Party Requestor's Comments After Patent Owner's Response and Amendment filed with the U.S. Patent and Trademark Office dated Apr. 25, 2008 for U.S. Appl. No. 95/000,112, 16 pages.
Amendment and Response to Notice Re: Defective Paper in Inter Partes Reexamination filed with the U.S. Patent and Trademark Office dated Oct. 24, 2008 for U.S. Appl. No. 95/000,112, 20 pages.
Third Party Requestor's Comments After Patent Owner's Amendment and Response to Notice Re: Defective Paper in Inter Partes Reexamination filed on Nov. 19, 2008 for U.S. Appl. No. 95/000,112, 2 pages.
Action Closing Prosecution filed by the U.S. Patent and Trademark Office on Jan. 8, 2009 for U.S. Appl. No. 95/000,112, 63 pages.
Patent Owner's Response to an Action Closing Prosecution filed with the U.S. Patent and Trademark Office on Feb. 9, 2009 for U.S. Appl. No. 95/000,112, 16 pages.
Third Party Requestor Comments to Patent Owner's Response filed with the U.S. Patent and Trademark Office on Mar. 6, 2009 for U.S. Appl. No. 95/000,112, 20 pages.
Amendment After Final or Under 37 CFR 1.312, initialed by the Examiner, filed with the U.S. Patent and Trademark office on Jun. 6, 2009 for U.S. Appl. No. 95/000,112, 1 page.
Patent Owner's Comments After Action Closing Prosecution filed with the U.S. Patent and Trademark Office on Jul. 2, 2009 for U.S. Appl. No. 95/000,112, 17 pages.
Right of Appeal Notice filed by the U.S. Patent and Trademark Office on Oct. 2, 2009 for U.S. Appl. No. 95/000,112, 52 pages.
Notice of Appeal filed with the Board of Patent Appeals and Interferences on Oct. 30, 2009 for U.S. Appl. No. 95/000,112, 2 pages.
Appeal Brief and Affidavits filed with the Board of Patent Appeals and Interferences on Jan. 11, 2010 for U.S. Appl. No. 95/000,112, 33 pages.
Requestor Appeal Brief filed with the Board of Patent Appeals and Interferences on Jan. 12, 2010 for U.S. Appl. No. 95/000,112, 36 pages.
Patent Owner—Respondent's Brief on Appeal filed with the Board of Patent Appeals and Interferences on Feb. 9, 2010 for U.S. Appl. No. 95/000,112, 16 pages.
Requestor Respondent Brief filed with the Board of Patent Appeals and Interferences on Feb. 11, 2010 for U.S. Appl. No. 95/000,112, 21 pages.
Amended Requestor Appeal Brief filed with the Board of Patent Appeals and Interferences on Aug. 20, 2010 for U.S. Appl. No. 95/000,112, 36 pages.
Amended Requestor Respondent Brief filed with the Board of Patent Appeals and Interferences on Aug. 20, 2010 for U.S. Appl. No. 95/000,112, 19 pages.
Amended Patent-Owner-Respondents Brief on Appeal filed with the Board of Patent Appeals and Interferences on Aug. 26, 2010 for U.S. Appl. No. 95/000,112, 16 pages.
Patent Owner-Appellant's Brief on Appeal filed with the Board of Patent Appeals and Interferences on Aug. 26, 2010 for U.S. Appl. No. 95/000,112, 30 pages.
Examiner's Answer to Appeal Brief filed with the Board of Patent Appeals and Interferences on Oct. 13, 2010 for U.S. Appl. No. 95/000,112, 5 pages.
Patent Owner's Rebuttal Brief filed with the Board of Patent Appeals and Interferences on Nov. 12, 2010 for U.S. Appl. No. 95/000,112, 9 pages.
Examiner's Answer to Appeal Brief filed with the Board of Patent Appeals and Interferences on Apr. 5, 2011 for U.S. Appl. No. 95/000,112, 2 pages.
Request for Reexamination of U.S. Pat. No. 6,767,247 filed with the U.S. Patent and Trademark Office on Jan. 13, 2006 for U.S. Appl. No. 95/000,119, 65 pages.
Determination—Reexam Ordered by the U.S. Patent and Trademark Office on Mar. 9, 2006 for U.S. Appl. No. 95/000,119, 36 pages.
Office Action filed by the U.S. Patent and Trademark Office dated Jun. 8, 2006 for U.S. Appl. No. 95/000,119, 1 06 pages.
Reply by Patent Owner to a Non-Final Office Action filed with the U.S. Patent and Trademark Office dated Aug. 4, 2006 for U.S. Appl. No. 95/000,119, 26 pages.
Third-Party Requester's Comments filed with the U.S. Patent and Trademark Office on Sep. 1, 2006 for U.S. Appl. No. 95/000,119, 25 pages.
Office Action filed by the U.S. Patent and Trademark Office dated Jan. 31, 2008 for U.S. Appl. No. 95/000,119, 86 pages.
Action Closing Prosecution filed by the U.S. Patent and Trademark Office on Feb. 12, 2008 for U.S. Appl. No. 95/000,119, 85 pages.
Patent Owner's Response to an Action Closing Prosecution filed with the U.S. Patent and Trademark Office on Mar. 10, 2008 for U.S. Appl. No. 95/000,119, 23 pages.
Third Party Requester Comments After Patent Owner's Response filed with the U.S. Patent and Trademark Office on Apr. 3, 2008 for U.S. Appl. No. 95/000,119, 11 pages.
Right of Appeal Notice filed by the U.S. Patent and Trademark Office on Sep. 26, 2008 for U.S. Appl. No. 95/000,119, 49 pages.
Notice of Appeal filed with the Board of Patent Appeals and Interferences on Oct. 24, 2008 for U.S. Appl. No. 95/000,119, 6 pages.
Appeal Brief—Owner filed with the Board of Patent Appeals and Interferences on Dec. 18, 2008 for U.S. Appl. No. 95/000,119, 23 pages.
Appeal Brief—Third-Party Requestor filed with Board of Patent Appeals and Interferences on Dec. 24, 2008 for U.S. Appl. No. 95/000,119, 40 pages.
Respondent Brief—Requestor filed with the Board of Patent Appeals and Interferences on Jan. 21, 2009 for U.S. Appl. No. 95/000,119, 23 pages.
Respondent Brief—Owner filed with the Board of Patent Appeals and Interferences for U.S. Appl. No. 951000,119 on Jan. 23, 2011, 29 pages.
Appeal Brief—Owner filed with the Board of Patent Appeals and Interferences for U.S. Appl. No. 95/000,119 on Jul. 13, 2009, 23 pages.
Nov. 1, 2016 Office Action issued in Chinese Patent Application No. 201310048136.5.
Feb. 27, 2017 Office Action Issued in U.S. Appl. No. 15/200,916.
Jun. 15, 2017 Office Action issued in Chinese Patent Application No. 201310048136.5.
Aug. 19, 2016 Office Action Issued in U.S. Appl. No. 15/200,916.
Appeal Brief—Third Party Requestor filed with the Board of Patent Appeals and Interferences for U.S. Appl. No. 95/000,119 on Jun. 18, 2010, 37 pgs.
Respondent Brief—Request filed with the Board of Patent Appeals and Interferences for U.S. Appl. No. 95/000,119 on Aug. 20, 2010, 18 pages.
Respondent Brief—Owner filed with the Board of Patent Appeals and Interferences for U.S. Appl. No. 95/000,119 on Aug. 26, 2010, 30 pages.
Examiner's Answer to Appeal Brief filed with the Board of Patent Appeals and Interferences for U.S. Appl. No. 95/000,119 on Oct. 13, 2010, 4 pages.
Rebuttal Brief—Owner filed with the Board of Patent Appeals and Interferences for U.S. Appl. No. 95/000,119 on Nov. 12, 2010, 7 pages.
International Search Report for PCT Application No. PCT/US01/14997, dated Aug. 28, 2001, 4 pages.
Board of Patent Appeals and Interferences Decision—Examiner Affirmed, for U.S. Appl. No. 95/000,119, dated Mar. 8, 2012, 42 pages.
Oral Argument Exhibits, for U.S. Appl. No. 95/000,119, dated Sep. 28, 2011, 51 pages.
*John Mezzalingua Associates, Inc.* v. *International Trade Commission*, filed as Non Patent Literature on Jun. 27, 2011 in U.S. Appl. No. 95/000,119, dated Apr. 28, 2011, 12 pages.

(56) References Cited

OTHER PUBLICATIONS

Notification of Litigation, for U.S. Appl. No. 95/000,119, dated Jun. 27, 2011, 2 pages.
Board of Patent Appeals and Interferences Decision—Examiner Affirmed, for U.S. Appl. No. 95/000,112, mailed Mar. 8, 2012, 36 pages.
Oral Argument Exhibits, for U.S. Appl. No. 95/000,112, dated Sep. 28, 2011, 50 pages.
*John Mezzalingua Associates, Inc.* v. *International Trade Commission*, filed as Non Patent Literature on Jun. 27, 2011 in U.S. Appl. No. 95/000,112, dated Apr. 28, 2011, 12 pages.
Notification of Litigation, for U.S. Appl. No. 95/000,112, dated Jun. 27, 2011, 2 pages.
Notice of Intent to Issue Ex Parte Reexamination Certificate, for U.S. Appl. No. 90/009,705, mailed Feb. 24, 2012, 10 pages.
Appeal Brief in Ex Parte Reexamination, for U.S. Appl. No. 90/009,705, dated Dec. 19, 2011, 30 pages.
Ex Parte Reexamination Advisory Action, for U.S. Appl. No. 90/009,705, dated Oct. 20, 2011, 3 pages.
Amendment and Reply, for U.S. Appl. No. 90/009,705, dated Oct. 13, 2011, 11 pages.
Ex Parte Reexamination Advisory Action, for U.S. Appl. No. 90/009,705, dated Sep. 2, 2011, 7 pages.
Amendment and Reply, for U.S. Appl. No. 90/009,705, dated Aug. 23, 2011, 1 page.
Amendment and Reply, for U.S. Appl. No. 90/009,705, dated Aug. 18, 2011, 12 pages.
Amendment and Reply, for U.S. Appl. No. 90/009,705, dated Aug. 17, 2011, 9 pages.
Communication and Ex Parte Reexamination Advisory Action, for U.S. Appl. No. 90/009,705, dated Jul. 19, 2011, 10 pages.
*John Mezzalingua Associates, Inc.* v. *International Trade Commission*, filed as Non Patent Literature on Jun. 27, 2011 in U.S. Appl. No. 95/009,105, dated Apr. 28, 2011, 12 pages.
Notification of Litigation, for U.S. Appl. No. 90/009,705, dated Jun. 27, 2011, 2 pages.
Office Action in Ex Parte Reexamination, for U.S. Appl. No. 90/009,705, dated May 19, 2011, 39 pages.
Ex Parte Reexamination Certificate for U.S. Pat. No. 7,192,308 C1, issued Apr. 10, 2012, 3 pages.
Order granting Request for Ex Parte Reexamination for Control U.S. Appl. No. 90/012,598, mailed Dec. 10, 2012, 29 pages.
Patent Owner Comments for Reexamination U.S. Appl. No. 95/000,112, filed Jun. 8, 2012, 11 pages.
Patent Owner Comments for Reexamination U.S. Appl. No. 95/000,119, filed Jun. 8, 2012, 11 pages.
Petition for Review for Reexamination U.S. Appl. No. 95/000,112, filed May 8, 2012, 37 pages.
Petition for Review for Reexamination U.S. Appl. No. 95/000,119, filed May 8, 2012, 43 pages.
Request for Ex Parte Reexamination of U.S. Pat. No. 6,530,807 and Declaration of Charles Eldering in Support of the Request for Ex Parte Reexamination, filed Sep. 14, 2012, 245 pages.
Request for Expedited Status Update for Reexamination U.S. Appl. No. 95/000,112, filed Aug. 3, 2012, 2 pages.
Request for Expedited Status Update for U.S. Appl. No. 95/000,119, filed Aug. 3, 2012, 2 pages.
Request for Rehearing by the Board of Patent Appeals and Interferences for Reexamination U.S. Appl. No. 95/000,112, filed May 8, 2012, 13 pages.
Request for Rehearing by the Board of Patent Appeals and Interferences for Reexamination U.S. Appl. No. 95/000,119, filed May 8, 2012, 14 pages.
Status Update for Reexamination U.S. Appl. No. 95/000,112, mailed Aug. 8, 2012, 4 pages.
Status Update for Reexamination U.S. Appl. No. 95/000,119, mailed Aug. 8, 2012, 4 pages.
Information Disclosure Statement Filed by Third Party filed with the U.S. Patent and Trademark Office on Mar. 17, 2010 for U.S. Appl. No. 90/009,705, 1 page.
Replacement Request for Reexamination of U.S. Pat. No. 7,192,308, filed Ex Parte with the U.S. Patent and Trademark Office on Apr. 19, 2011 for U.S. Appl. No. 90/009,705, 364 pages.
Determination—Re-exam Ordered filed by the U.S. Patent and Trademark Office on Jun. 29, 2010 for U.S. Appl. No. 90/009,705, 36 pages.
Non-final Office Action filed by the U.S. Patent and Trademark Office dated Nov. 23, 2011 for U.S. Appl. No. 90/009,705, 29 pages.
Reply by Patent Owner to a Non-Final Office Action filed with the U.S. Patent and Trademark Office dated Jan. 21, 2011, for U.S. Appl. No. 90/009,705, 37 pages.
Request for Reexamination of U.S. Pat. No. 6,530,807 filed with the U.S. Patent and Trademark Office on Sep. 20, 2005, for U.S. Appl. No. 95/000,112, 75 pages.
Determination—Re-exam Ordered filed by the U.S. Patent and Trademark Office on Nov. 17, 2005 for U.S. Appl. No. 95/000,112, 26 pages.
Non-final Office Action filed by the U.S. Patent and Trademark Office dated Dec. 13, 2005 for U.S. Appl. No. 95/000,112, 41 pages.
Reply by Patent Owner to a Non-Final Office Action filed with the U.S. Patent and Trademark Office dated Feb. 2, 2006 for U.S. Appl. No. 95/000,112, 15 pages.
Decision Returning Unauthorized Paper under 37 CFR 1.947 & 1.948 filed by the U.S. Patent and Trademark Office filed Nov. 29, 2007 for U.S. Appl. No. 95/000,112, 4 pages.

* cited by examiner

FIG. 1
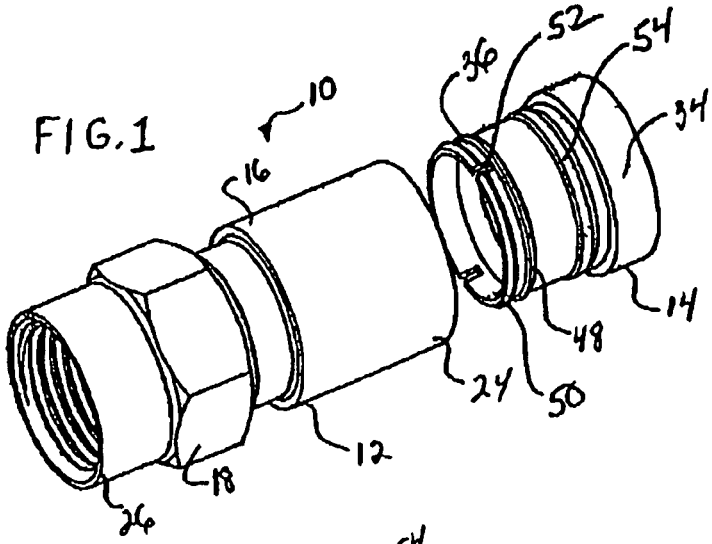
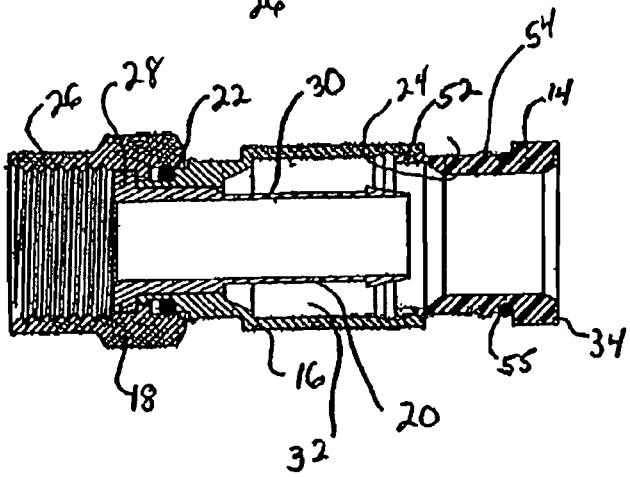
FIG. 2
FIG. 3
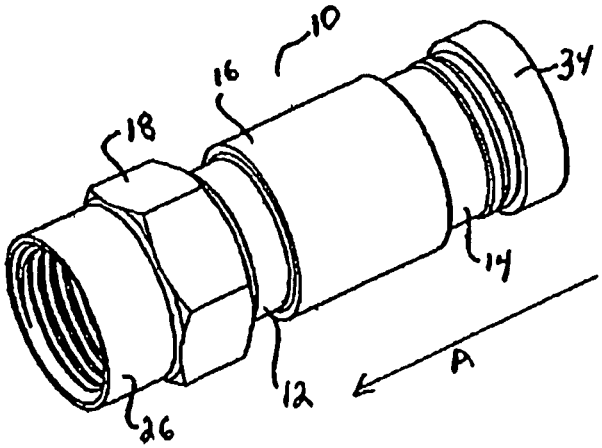

COAXIAL CONNECTOR HAVING DETACHABLE LOCKING SLEEVE

CROSS-REFERENCE TO RELATED APPLICATIONS

This application is a continuation of U.S. application Ser. No. 15/200,916, filed Jul. 1, 2016, pending, which is a continuation of U.S. application Ser. No. 14/550,021 filed Nov. 21, 2014, now U.S. Pat. No. 9,385,467, which is a continuation of U.S. application Ser. No. 13/903,348 filed May 28, 2013, now U.S. Pat. No. 8,894,440, which is a continuation of U.S. application Ser. No. 12/254,238 filed Oct. 20, 2008, now U.S. Pat. No. 8,449,324, which is a continuation of U.S. application Ser. No. 11/657,868, filed Jan. 25, 2007, now U.S. Pat. No. 7,458,849, which is a continuation of U.S. application Ser. No. 10/848,497, filed May 18, 2004, now U.S. Pat. No. 7,192,308, which is a continuation of U.S. application Ser. No. 10/359,498 filed Feb. 6, 2003, now U.S. Pat. No. 6,767,247, which is a continuation of U.S. application Ser. No. 09/852,343 filed May 9, 2001, now U.S. Pat. No. 6,530,807, which claims priority to U.S. Provisional Application No. 60/215,299 filed Jun. 30, 2000, and U.S. Provisional Application No. 60/202,972 filed May 10, 2000. These applications are hereby incorporated by reference.

TECHNICAL FIELD

The present disclosure relates generally to connectors for terminating coaxial cable. More particularly, the present disclosure relates to a coaxial cable connector having a locking sleeve which is detachably coupled to the connector body.

BACKGROUND

It has long been known to use connectors to terminate coaxial cable so as to connect a cable to various electronic devices such as televisions, radios and the like. Conventional coaxial cables typically include a center conductor surrounded by an insulator. A braided or foil conductive shield is disposed over the insulator. An outer insulative jacket surrounds the shield. In order to prepare the coaxial cable for termination, the outer jacket is stripped back exposing an extent of the conductive shield which is folded back over the jacket. A portion of the insulator extends outwardly from the jacket and an extent of the center conductor extends outwardly from insulator. Such a prepared cable may be terminated in a conventional coaxial connector.

Coaxial connectors of this type include a connector body having an inner cylindrical post which is inserted between the insulator and the conductive shield. A locking sleeve is provided to secure the cable within the body of the coaxial connector. The locking sleeve, which is typically formed of a resilient plastic, is securable to the connector body to secure the coaxial connector thereto. As coaxial connectors of this type require a two-piece construction, including the body and the sleeve, often during shipping, handling and installation, the parts may become lost or misplaced.

U.S. Pat. No. 4,834,675 addresses this problem by providing a coaxial connector where the locking sleeve is frangibly tethered to the connector body. Prior to installation, the locking sleeve is frangibly removed from the connector body whereupon the locking sleeve is inserted onto the cable and the cable is inserted into the connector body for securement thereto. While the connector of the '675 patent reduces the risk of mishandling or loss of the connector components during shipment, upon installation the locking sleeve must still be removed from the connector body and attached to the cable separately. Thus, there is still a risk of mishandling or loss of components during installation.

This problem is further addressed in U.S. Pat. No. 5,470,257 where a coaxial connector is provided with a locking sleeve being inseparably coupled to a connector body. Cable termination using the connector of the '257 patent requires that the prepared coaxial cable be inserted axially through both the locking sleeve and connector body. Thereafter, the locking sleeve can be axially advanced so as to secure the cable in the connector body.

While in many installations, this form of cable termination is acceptable, it has been found that insertion of the prepared cable through both the locking sleeve and the connector body may be difficult in certain situations. As the cable installer typically works outdoors in an elevated or underground environment, it may become difficult to "blind" insert the prepared cable through the locking sleeve and into proper position around the cylindrical post of the connector body. In these situations, it would be desirable to permit the removal of the locking sleeve from the connector body so that the cable could be directly inserted into the connector body.

Therefore, there is a need to overcome, or otherwise lessen the effects of, the disadvantages and the shortcomings described above.

SUMMARY

It is an object of the present invention to provide a coaxial cable connector for terminating a coaxial cable.

It is a further object of the present invention to provide a coaxial cable connector having a connector body and a locking sleeve where the locking sleeve secures the cable within the connector body.

It is a further object of the present invention to provide a coaxial cable connector having a connector body and a locking sleeve in detachable, re-attachable snap engagement with the connector body to permit direct insertion of the cable through the locking sleeve and the connector body. Alternatively, where circumstances require, the present invention permits removal of the locking sleeve from the connector body for subsequent separate reattachment.

It is another object of the present invention to provide a method of terminating a coaxial cable. In the efficient attainment of these and other objects, the present invention provides a coaxial cable connector. The connector of the present invention includes a connector body having a cable receiving end and an opposed connection end. A locking sleeve is provided in detachable, re-attachable snap engagement with the insertion end of the connector body for securing the cable in the connector body. The locking sleeve is movable from a first position loosely retaining the cable in the connector body to a second position locking said cable to the connector body.

In a preferred embodiment of the present invention, the locking sleeve is in resilient detachable, re-attachable snap engagement with the connector body. The resilient detachable, re-attachable engagement is provided by cooperative detent structure between a portion of the sleeve insertable into the connector body and a portion of the connector body which receives the sleeve. This detent structure includes a rib and groove arrangement which provides for the detachable coupling of the sleeve to the connector body.

In a further preferred embodiment, the detachable engagement of the sleeve to the connector body may include one or more slots extending through the end of the sleeve which is inserted into the connector body. The slots facilitate resilient detachment and reattachment of the sleeve from the connector body.

In its method aspect, the present invention provides for the termination of a coaxial connector with a connector. The method provides for the detaching of a locking sleeve from a connector body. The sleeve is then positioned over the cable. The cable is then inserted into the end of the connector. The sleeve is then reattached to the end of the connector body to secure the cable thereto.

BRIEF DESCRIPTION OF THE DRAWINGS

FIG. 1 is an exploded perspective showing of the coaxial connector of the present invention including a connector body and a detachably coupled locking sleeve.

FIG. 2 is a longitudinal sectional showing of the connector of FIG. 1.

FIG. 3 shows the connector of FIG. 1 with the sleeve detachably coupled to the connector body.

DETAILED DESCRIPTION OF EMBODIMENTS

Figure 4:
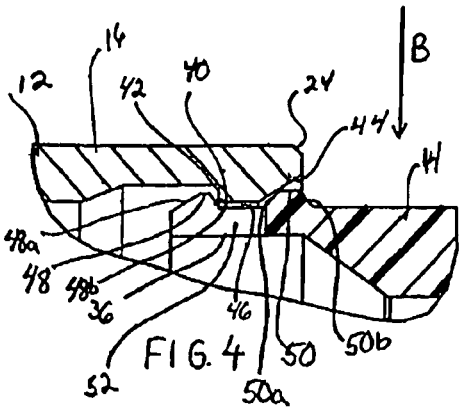
FIGS. 4-6 are enlarged sectional showings of the engagement between the connector body and the locking sleeve.

The present invention is directed to connectors for terminating coaxial cable. Coaxial connectors of this type are shown and described in U.S. Pat. No. 4,834,675 issued May 30, 1989, which is incorporated by reference herein for all purposes.

Referring to FIGS. 1-3, the coaxial cable connector 10 of the present invention is shown. Connector 10 includes two major components, a connector body 12 and a locking sleeve 14 attachably coupled to body 12. Body 12 is an elongate generally cylindrical conductive member typically formed of metal, preferably brass. Body 12 includes an annular collar 16 for accommodating a coaxial cable, an annular nut 18 rotatably coupled to collar 16 for providing mechanical attachment of the connector to an external device. Interposed between collar 16 and nut 18 is an annular post 20. A resilient sealing 0-ring 22 may be positioned between collar 16, and nut 18 at the rotatable juncture thereof to provide a seal thereat. Collar 16 includes a cable receiving end 24 for insertably receiving an inserted coaxial cable. Nut 18 includes an internally threaded end extent 26 permitting screw threaded attachment of body 12 to the external device. Cable receiving end 24 and internally threaded end extension 26 define the opposed ends of connector body 12. Annular post 20 includes a base portion 28 which provides for securement of post 20 between nut 18 and collar 16 and an annular tubular extension 30 extending into collar 18. As will be described in further detail hereinbelow and as is conventionally known, the extension 30 of post 20 and the collar 16 define an annular chamber 32 for accommodating the jacket and shield of the inserted coaxial cable.

Locking sleeve 14 is a generally cylindrical member formed of resilient material preferably a synthetic plastic such as an acetate resin. Locking sleeve 14 includes a flared rearward end 34 through which a cable may be inserted. Opposite rearward end 34 is a forward end 36 which is insertable into receiving end 24 of collar 16. As will be described in further detail hereinbelow, the forward end 36 of locking sleeve 14 and the receiving end 24 of collar 16 include cooperative detent structure which allows for the detachable, re-attachable connection of locking sleeve 14 to body 12. Furthermore, connector 10 is designed such that locking sleeve 14 is axially moveable along arrow A of FIG. 3, towards nut 18 from a first position shown in FIG. 4, which loosely retains the cable within connector body 12 through an intermediate position shown in FIG. 5, to a more forward second position shown in FIG. 6, which secures the cable within connector body 12.

The connector 10 of the present invention is constructed so as to be supplied in the assembled condition shown in FIG. 3. In such assembled condition, and as will be described in further detail hereinbelow, a coaxial cable may be inserted through the rearward end 34 of locking sleeve 14 and through connector body 12. The locking sleeve may be moved from the first position loosely retaining the cable to the second position which is axially forward thereby locking the cable to the connector body. It is, however, contemplated that the locking sleeve 14 may be detached from connector body 12 and in a manner which will be described in further detail hereinbelow, so as to allow the coaxial cable to be inserted directly into receiving end 24 of connector body 12. Thereafter, the locking sleeve 14 which has been placed around the cable may be reattached to receiving end 24 of body 12 where it can be moved from the first position to the second position locking the cable to the connector body. The cooperating detent structure mentioned above is employed to provide such detachment and reattachment of locking sleeve 14 to connector body 12. With additional reference to FIGS. 4-6, the cooperating detent structure is shown.

Receiving end 24 of collar 16 of connector body 12 includes a radially inwardly directed annular rib 40 extending adjacent the distal end thereof. Rib 40 is defined by a forwardly facing perpendicular wall 42 and a rearwardly facing chamfered wall 44. The cooperating detent structure of the present invention further includes the forward end 36 of locking sleeve 14 formed to have a radially outwardly opening annular groove 46 adjacent a distal end thereof. Groove 46 is constructed so as to receive rib 40 of collar 16. Groove 40 is defined by a pair of spaced apart radially outwardly directed rings 48 and 50. Ring 48 which is axially forward of ring 50 is defined by opposed oppositely chamfered walls **48*a* and 48*b*. Similarly, ring 50 which is axially rearward, is defined by a pair of opposed oppositely chamfered walls 50*a* and 50*b*. As may be appreciated, the forward end 36 of locking sleeve 14 may be inserted into the receiving end 24 of collar 16. Upon insertion, the forward chamfered wall 48*a* of ring 48 bears against chamfered wall 44 of collar 16. Due to the resilient nature of material forming locking sleeve 14, the ring 48 will ride over rib 40 and the rib 40 will become lockingly resident within groove 46. This defines the first position of locking sleeve 14**.

While the locking sleeve is accommodated in collar 16 by engagement between the rib 40 in groove 46, locking sleeve 40 may be detachably removed from locking sleeve 14. Such detachable removal is facilitated by the resiliency of the plastic material forming locking sleeve 40 and relative thickness of the sleeve wall thereat. Furthermore, ring 48 includes rearward chamfered wall **48*b* which permits the wall to ride against perpendicular wall 42 of sleeve 16 upon rearward movement of locking sleeve 14. Such construction of the forward end 36 of sleeve 14 together with the formation of chamfered wall 48*b* and the resiliency and the thinness of the plastic material, allows the locking sleeve to be detachably coupled from the collar 16**.

Figure 5:
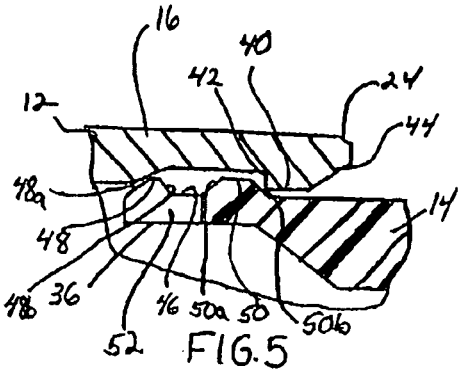

Furthermore, as particularly shown in FIGS. 1 and 4-6, the forward end 36 of the locking sleeve may include one or more axially extending slots 52 therethrough. The slots 52 are optionally included to enhance the resilient deflectability of the forward end 36 of locking sleeve 14. Where used, slots may be provided in any number desired to provide the degree of flexibility required to removably detach locking sleeve 14 from collar 16 without making the locking sleeve so deflectable that it inadvertently detaches from collar 16 during normal handing and shipment. Furthermore, the length of slots 52 may be selected to enhance the flexibility of forward end 36. As shown in FIGS. 4 and 5, a longer slot 52 may be provided as compared with a shorter slot shown in FIG. 6.

It is further contemplated that while the locking sleeve is designed to be detachably coupled from collar 16 by moving sleeve 14 in a rearward direction with respect to collar 16, a slight transverse force in a direction of arrow B may be of assistance in detaching locking sleeve 14 from collar 16.

Figure 6:
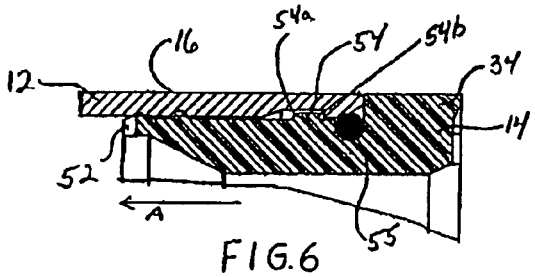
Figure 7:
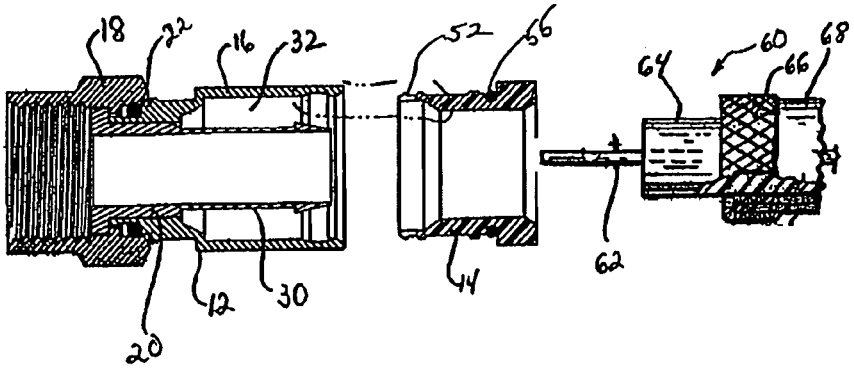
FIG. 7 is an exploded sectional showing of the termination of a prepared coaxial cable with the connector of the present invention.

As more fully shown in FIGS. 6 and 7, the cooperative detent structure further includes a radially outwardly extending end ring 54 adjacent rearward end 34 of sleeve 14. Upon continued coaxial movement along arrow A, ring 54 engages and rides over rib 40 of collar 16 to define the second position which locks cable to connector body 12.

Having described the components of connector 10 in detail, the use of connector 10 in terminating a coaxial cable may now be described with respect to FIG. 4-7. Coaxial cable 60 includes an elongate inner conductor 62 formed of copper or similar conductive material. Extending around inner conductor 62 is a conductor insulator 64 formed of a suitably insulative plastic. A metallic shield 66 is positioned in surrounding relationship around insulator 64. As shown in FIG. 5, shield 66 is a metallic braid, however, other conductive materials such as metallic foil may also be employed. Covering shield 66 is an outer insulative jacket 68.

Cable 60 is prepared in conventional fashion for termination, by stripping back jacket 68 exposing an extent of shield 66. A portion of insulator 64 extends therefrom with an extent of conductor 62 extending from insulator 64. The preparation process includes folding back an end extent of shield 66 about jacket 68. As shown in exploded view in FIG. 7, cable 60 may be inserted into connector 10 with the locking sleeve 14 coupled to collar 16 of body 12 as shown in FIGS. 2 and 3. In this technique, the prepared cable 60 is inserted through rearward end 34 of sleeve 14 and into the receiving end 24 of collar 16. Extension 30 of post 20 of body 12 is inserted between the insulator 64 in the metallic shield 66 such that the shield and the jacket 68 reside within the annular region 32 defined between post 20 and collar 16. In this position, the locking sleeve is coupled to collar 16 in the first position shown in FIG. 4. In such first position, sufficient clearance is provided between sleeve 14 and collar 16 so that extension 30 may easily be interposed between insulator 64 and shield 66.

Once the cable 60 is properly inserted, the locking sleeve 14 may be moved from the first position shown in FIG. 4, to an intermediate position shown in FIG. 5, where the locking sleeve is moved axially forward so that the rearward ring 50 rides over rib 40 so as to reside forward of perpendicular wall 42. Such movement is facilitated by the chamfered wall 44 of receiving end 24 of collar 16 and the forward chamfered wall 50*a* of ring 50. In this second position, the jacket 68 and shield 66 of cable 60 begins to become compressively clamped within annular region 32 between post 20 and collar 16. The sleeve 14 is further axially advanced along arrow A from the intermediate position shown in FIG. 5, to a second position shown in FIG. 6. Such second position is achieved as the end ring 54 resiliently rides over rib 40 of collar 16. In that regard, end ring 54 has a forwardly chamfered front wall 54*a* for engagement with chamfered wall 44 of collar 16 to facilitate such resilient movement. Further, the rear wall 54*b* of ring 54 is perpendicular so as to engage perpendicular wall 42 of rib 40 to maintain sleeve 14 in the second position with respect to collar 16. A suitable tool may be used to effect movement of locking sleeve 14 from its first position to its second position securing cable 60 to connector body 12.

It is contemplated that the engagement between insulative jacket 68 and the connector body 12 establishes a sealed engagement thereat. In order to further facilitate the seal, locking sleeve 14 may optionally support a sealing 0-ring 55 which provides a seal with the chamfered wall 44 of collar 16 in the second position.

As may be appreciated, proper insertion of cable 60 into connector body 12 requires that the cable be inserted in such a manner that the extension 30 of post 20 becomes resident between insulator 64 and shield 66. In certain installation settings, the installer may not have clear and convenient access when terminating cable 60. Moreover, insertion may be rendered difficult by poor cable preparation, which may result in a frayed end. Therefore, it may be difficult for the installer to blindly insert the cable 60 through the locking sleeve 14 and into connector body 12. In such situations, the present invention contemplates the ability to detachably remove locking sleeve 14 from connector body 12 so that the cable may be directly inserted to receiving end 24 of collar 16. In these situations, locking sleeve 14 is detachably removed from collar 16 in a manner facilitated as above described. The locking sleeve is then slipped over cable 60 and moved to a convenient position along the cable length. The end of cable 60 may then be inserted directly into the rearward end 34 of collar 16 to easily assure that extension 30 of post 20 is inserted between insulator 64 and shield 66. Thereafter, the locking sleeve 14 may be brought up along the cable and the forward end 36 of locking sleeve 14 may be inserted into the rearward end 34 of collar 16. The chamfered wall 48*a* of ring 48 together with the chamfered wall 44 of collar 16, and optionally the slots 52, facilitates insertion of the locking sleeve into collar 16 so that rib becomes resident within groove 46 as shown in FIG. 4 defining the first position. Thereafter, as described above, the locking sleeve may be moved from the first position shown in FIG. 4 to a second position shown in FIG. 6 where the end ring 54 becomes resident forward of perpendicular wall 42 thereby locking cable 60 in connector body 12.

Various changes to the foregoing described and shown structures will now be evident to those skilled in the art. Accordingly, the particularly disclosed scope of the invention is set forth in the following claims.

What is claimed is:

1. A connector configured to terminate an end of a coaxial cable, the connector comprising:

a connector body comprising a cable receiving end configured to receive the end of the coaxial cable, a second opposite end, and a retention structure adjacent the cable receiving end; and a locking sleeve comprising a forward end and a rearward end, the locking sleeve including a receiving area at the forward end, the locking sleeve being configured to couple to the cable receiving end of the connector body, to detach defining a detached configuration, and to attach defining an attached configuration, wherein the locking sleeve is configured to insertably receive the end of the coaxial cable in the detached configuration, to attach to the connector body when the connector body has received the coaxial cable, and to slide in a longitudinal direction with respect to the connector body from a first attached position to a second attached position, the second attached position being configured to lock the coaxial cable to the connector body, wherein the locking sleeve is configured to cooperatively interact with an inner surface of the connector body proximate the cable receiving end in both the first attached position and the second attached position, wherein the receiving area is configured to engage the retention structure in the first attached position to resist longitudinal sliding movement of the locking sleeve from the first attached position, and wherein the receiving area includes a forwardmost portion and a rearwardmost portion, the forwardmost portion being nearer to the forward end than the rearwardmost portion, and the rearwardmost portion being nearer to the forward end than to the rearward end.

2. The connector of claim 1, wherein the retention structure is loosely retained by the locking sleeve when in the first attached position.

3. The connector of claim 1, wherein the connector is configured to loosely retain the coaxial cable within the connector when in the first attached position.

4. The connector of claim 1, wherein the retention structure comprises an inwardly directed rib.

5. The connector of claim 4, wherein the inwardly directed rib comprises a first rib wall adjacent to the cable receiving end and a second rib wall opposite the first rib wall, the second rib wall being perpendicular to the connector body.

6. The connector of claim 5, wherein the locking sleeve further comprises an annular ring surface, the annular ring surface comprising a first ring wall and a second ring wall opposite the first ring wall, the second rib wall being configured to abut the second ring wall when in the second attached position.

7. The connector of claim 1, wherein the locking sleeve further comprises two annular ring surfaces defining the receiving area.

8. The connector of claim 7, wherein the retention structure is loosely retained between the two annular ring surfaces when in the first attached position.

9. The connector of claim 8, wherein the retention structure comprises an inwardly directed rib.

10. The connector of claim 1, wherein the locking sleeve is configured to be radially compressed by the retention structure in the first attached position.

11. The connector of claim 10, wherein the locking sleeve comprises a resilient material.

12. The connector of claim 10, wherein the retention structure comprises an inwardly directed rib.

13. A coaxial cable connector comprising:

a connector body having a cable receiving end, an opposed connection end, and a retention structure adjacent the cable receiving end; and a locking sleeve having a forward end, a rearward end, and a receiving area at the forward end, the receiving area being configured to cooperate with the retention structure to place the locking sleeve in detachable, re-attachable engagement with the cable receiving end of the connector body for securing a cable in the connector body, wherein said locking sleeve is configured to detach from the connector body defining a detached configuration and to attach to the connector body defining an attached configuration, wherein the locking sleeve is configured to insertably receive the end of the coaxial cable in the detached configuration, to attach to the connector body when the connector body has received the coaxial cable, wherein, in the attached configuration, the locking sleeve is longitudinally movable relative to the connector body from a first position loosely retaining the cable in the connector body to a second position inseparably locking the cable to the connector body, wherein the locking sleeve is configured to cooperatively interact with an inner surface of the connector body proximate the cable receiving end in both the first position and the second position, wherein the receiving area is configured to engage the retention structure in the first position to resist longitudinal movement of the locking sleeve from the first position, and wherein the receiving area includes a forwardmost portion and a rearwardmost portion, the forwardmost portion being nearer to the forward end than the rearwardmost portion, and the rearwardmost portion being nearer to the forward end than to the rearward end.

14. The connector of claim 13, wherein the retention structure is loosely retained by the locking sleeve when in the first position.

15. The connector of claim 13, wherein the connector is configured to loosely retain the coaxial cable within the connector when in the first position.

16. The connector of claim 13, wherein the retention structure comprises an inwardly directed rib.

17. The connector of claim 16, wherein the inwardly directed rib comprises a first rib wall adjacent to the cable receiving end and a second rib wall opposite the first rib wall, the second rib wall being perpendicular to the connector body.

18. The connector of claim 17, wherein the locking sleeve further comprises an annular ring surface, the annular ring surface comprising a first ring wall and a second ring wall opposite the first ring wall, the second rib wall being configured to abut the second ring wall when in the second position.

19. The connector of claim 13, wherein the locking sleeve further comprises two annular ring surfaces defining the receiving area.

20. The connector of claim 19, wherein the retention structure is loosely retained between the two annular ring surfaces when in the first position.

21. The connector of claim 20, wherein the retention structure comprises an inwardly directed rib.

22. The connector of claim 13, wherein the locking member is configured to be radially compressed by the retention structure in the first position.

23. The connector of claim 22, wherein the locking sleeve comprises a resilient material.

24. The connector of claim 22, wherein the retention structure comprises an inwardly directed rib.

* * * * *